US009093016B2

(12) United States Patent
Ito

(10) Patent No.: US 9,093,016 B2
(45) Date of Patent: Jul. 28, 2015

(54) ELECTRO-OPTICAL DEVICE AND ELECTRONIC APPARATUS FOR COLOR SAMPLING AND DISPLAY

(71) Applicant: SEIKO EPSON CORPORATION, Tokyo (JP)

(72) Inventor: Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/154,183

(22) Filed: Jan. 14, 2014

(65) Prior Publication Data

US 2014/0125572 A1 May 8, 2014

Related U.S. Application Data

(62) Division of application No. 12/916,496, filed on Oct. 30, 2010, now Pat. No. 8,659,526.

(30) Foreign Application Priority Data

Nov. 2, 2009 (JP) ..... 2009-251754

(51) Int. Cl.
*G09G 3/36* (2006.01)
*G09G 3/20* (2006.01)

(52) U.S. Cl.
CPC ..... *G09G 3/2003* (2013.01); *G09G 3/36* (2013.01); *G09G 3/3688* (2013.01); *G09G 2300/0426* (2013.01); *G09G 2370/08* (2013.01)

(58) Field of Classification Search
CPC ..... G09G 3/3674
USPC ..... 345/100, 88
See application file for complete search history.

(56) References Cited

U.S. PATENT DOCUMENTS

| | | | | |
|---|---|---|---|---|
| 6,448,953 | B1 | 9/2002 | Murade | |
| 7,804,473 | B2 | 9/2010 | Kumeta | |
| 2003/0001831 | A1 | 1/2003 | Murade | |
| 2005/0168423 | A1 * | 8/2005 | Hirata et al. | 345/88 |
| 2008/0170008 | A1 | 7/2008 | Kim | |
| 2009/0002357 | A1 | 1/2009 | John et al. | |
| 2009/0213054 | A1 * | 8/2009 | Masui | 345/88 |
| 2012/0146972 | A1 | 6/2012 | Fujikawa | |

FOREIGN PATENT DOCUMENTS

| | | | |
|---|---|---|---|
| JP | 2001356366 | A | 12/2001 |
| JP | 200249331 | A | 2/2002 |
| JP | 2003287774 | A | 10/2003 |

* cited by examiner

*Primary Examiner* — Roy Rabindranath
(74) *Attorney, Agent, or Firm* — Lowe Hauptman & Ham, LLP

(57) ABSTRACT

An electro-optical device includes, on a substrate, three sub-pixels, three sampling switches, three data lines, three image signal lines, and three lead wiring lines. The three sub-pixels correspond to red, green and blue, respectively. The three sub-pixels are included in a unit pixel. The three sampling switches correspond to the three sub-pixels, respectively. The three data lines electrically connect the three sub-pixels and the three sampling switches with each other, respectively. The three image signal lines, which are provided on a side opposite to the three sub-pixels with respect to the three sampling switches, correspond to the three sampling switches, respectively. The three lead wiring lines electrically connect the three sampling switches and the three image signal lines with each other, respectively. Among the three sampling switches, a sampling switch corresponding to green is disposed close to the three image signal lines compared to other two sampling switches.

2 Claims, 7 Drawing Sheets

ELECTRO-OPTICAL DEVICE AND ELECTRONIC APPARATUS FOR COLOR SAMPLING AND DISPLAY

BACKGROUND

1. Technical Field

The present invention relates to technical fields of an electro-optical device, such as a liquid crystal display device, and an electronic apparatus, such as a liquid crystal projector, including the electro-optical device.

2. Related Art

As this kind of electro-optical device, there is, for example, a liquid crystal device that is driven in accordance with image signals supplied from external circuits to image signal lines. The image signals are supplied from the image signal lines through sampling circuits to a plurality of data lines arranged in a pixel region on a substrate. The sampling circuit is provided in a peripheral region located in the periphery of the pixel region, and includes a sampling switch made up of a thin film transistor (TFT) and the like. For example, JP-A-2002-049331 proposes a technique of arranging sampling switches adjacent to one another at predetermined intervals with respect to the longitudinal direction of the sampling switches, which results in a reduction in parasitic capacitance between an image signal line and a data line in proximity to the sampling switch.

As one example of this kind of electro-optical device, there is a color display type liquid crystal device having red (R), green (G) and blue (B) sub-pixels. In such a color display type liquid crystal device, a single one unit pixel is divided into three sub-pixels, and color filters of three colors, R, G and B, are arranged at positions corresponding to the sub-pixels. One unit pixel is displayed using the three sub-pixels corresponding to three colors, R, G and B. Color display is thus enabled.

In this color display type liquid crystal device, sampling switches are provided on the data lines that are arranged so as to correspond to the respective colors of R, G and B sub-pixels. This makes it difficult to arrange sampling switches so as to form one row along the arrangement direction of data lines in the peripheral region on the substrate. To solve this issue, as disclosed in JP-A-2002-049331, which has been mentioned above, the arrangement of a plurality of sampling switches may be such that the sampling switches are each arranged in a direction of arrangement of data lines, and are disposed so as to form a plurality of lines displaced with respect to one another along a direction in which the data lines extend.

Here, in cases where an image signal is supplied through such a sampling switch as mentioned above to a data line, the transmission of the image signal to the sampling switch is performed via an image signal line and a lead wiring line laid between a connection terminal and the sampling switch to supply the image signal to the sampling switch. At this point, regarding a line from the connection terminal to the sampling switch, there exist a rounded signal waveform and variations in potential that are caused by wiring capacitance and capacitive coupling between the line and another line. As a result, adverse effects on the image signal are likely to occur. Particularly in color display, adverse effects of these defects vary by color, and cause green (G) color to be prominently displayed. This becomes a cause of display irregularities. Thus, a technical problem arises in that display abnormality may occur in a pixel region.

SUMMARY

An advantage of some aspects of the invention is that it provides an electro-optical device that makes it difficult to visually recognize adverse effects on display due to potential variations and the like that can be produced in lines to the sampling switches, so that a high-quality image can be displayed, and an electronic apparatus including the electro-optical device.

An electro-optical device according to a first aspect of the invention includes, on a substrate, three sub-pixels that respectively correspond to red, green and blue and which are included in a unit pixel; three sampling switches that respectively correspond to the three sub-pixels; three data lines that respectively electrically connect the three sub-pixels and the three sampling switches with each other; three image signal lines that are provided on a side opposite to the three sub-pixels with respect to the three sampling switches and which respectively correspond to the three sampling switches; and three lead wiring lines that respectively electrically connect the three sampling switches and the three image signal lines with each other. Among the three sampling switches, a sampling switch corresponding to green is disposed close to the three image signal lines compared to other two sampling switches.

Regarding the electro-optical device according to the first aspect of the invention, three sub-pixels respectively corresponding to red, green and blue are included on a substrate. The three sub-pixels are included in a unit pixel. The three sub-pixels are electrically connected through three data lines to three sampling switches, respectively. Ends (on a side opposite to the side connected to the data lines) of the three sampling switches are electrically connected through the three lead wiring lines to three image signal lines, respectively. Note that the electro-optical device according to the first aspect of the invention is provided with the three sub-pixels, every one of which typically includes a plurality of sub-pixels; the three data lines, every one of which typically includes a plurality of data lines; the three sampling switches, every one of which typically includes a plurality of sampling switches; the three lead wiring lines, every one of which typically includes a plurality of lead wiring lines; and the three image signal lines, every one of which typically includes a plurality of image signal lines.

At the time of operation of the electro-optical device according to the first aspect of the invention, for example, sampling signals are supplied from a data line driving circuit through a sampling signal line to gates of the three sampling switches. Image signals supplied to an image signal line are sampled in the three sampling switches in response to the sampling signals and are supplied to the three data lines. On the other hand, for example, scanning signals are sequentially supplied from a scanning line driving circuit to the scanning lines. Accordingly, for example, in a sub-pixel including a pixel switching element, a pixel electrode, a storage capacitor and the like, electro-optical operation such as driving a liquid crystal is performed on a sub-pixel-to-sub-pixel basis. As a result, color display in a pixel region is enabled.

Particularly in the first aspect of the invention, among the three sampling switches, a sampling switch corresponding to green is disposed close to the three image signal lines compared to other two sampling switches (i.e., the sampling switches corresponding to red and blue). Note that the sampling switch corresponding to green need not be disposed close to all the three image signal lines and has only to be disposed close to the image signal line corresponding to green among the three image signal lines. Specifically, the distance between the sampling switch corresponding to green and the image signal line corresponding to green has only to be shorter than the distance between the sampling switch corresponding to red and the image signal line corresponding to red and the distance between the sampling switch corresponding to blue and the image signal line corresponding to blue.

According to this configuration, it is possible to make shorter the length of a lead wiring line connected to the sampling switch corresponding to green than the lengths of lead wiring lines connected to the sampling switches corresponding to red and blue. Accordingly, the wiring line corresponding to green can be made such that a rounded signal waveform caused by wiring capacitance and variations in potential due to capacitive coupling between this line and another line are least likely to occur.

Here, in particular, green offers a high luminosity factor (or luminous efficiency) compared to red and blue. Therefore, by reducing the possibilities of the potential variations in the lead wiring line corresponding to green, it is possible to efficiently reduce adverse effects of the potential variations on a displayed image. Specifically, the "rounded waveform" produced in an image signal can be reduced. Note that even when variations in potential occur in the lead wiring lines respectively corresponding to red and blue, there is little or practically no adverse effect on a displayed image since red and blue offer lower luminosity factors than green. As a result, a high-quality color image can be displayed.

As described above, with the electro-optical device according to the first aspect of the invention, it is difficult to visually recognize adverse effects on display due to the potential variations that can be produced in the image signal line and the lead wiring line. Thus, a high-quality image can be displayed.

In the electro-optical device according to the first aspect of the invention, it is preferable that, among the three sampling switches, a sampling switch corresponding to the blue be disposed so as to be distant from the image signal lines compared to a sampling switch corresponding to the red.

In this case, the potential variations in the lead wiring line corresponding to red can be made smaller than the potential variations in the lead wiring line corresponding to blue. Here, since blue offers a lower luminosity factor than red, it can be made difficult to visually recognize the adverse effects on display due to potential variations that can be produced in the lead wiring line, compared to the hypothetical case in which the sampling switch corresponding to red is disposed so as to be more distant from the image signal lines than the sampling switch corresponding to blue.

In the electro-optical device according to the first aspect of the invention, it is preferable that the three sampling switches each include a plurality of sampling switches, and be arranged in one direction intersecting the other direction along which the three data lines are arranged, and arranged so as to be displaced from one another in the other direction.

In this case, the sampling switches corresponding to red, the sampling switches corresponding to green, and the sampling switches corresponding to blue are arranged to form one row along one direction, and are arranged to form three rows such that each row is arranged in the other direction. Accordingly, the sampling switches corresponding to red, the sampling switches corresponding to green, and the sampling switches corresponding to blue can be easily arranged in a peripheral region located around the pixel region in which pixels are arranged, while each sampling switch is made of a TFT or the like having a larger size than a sub-pixel.

In the electro-optical device according to the first aspect of the invention, it is preferable that, among the three lead wiring lines, a lead wiring line corresponding to one of the three image signal lines be electrically connected to the corresponding one of the three image signal lines, and that the lead wiring line corresponding to one of the three image signal lines include a plurality of lead wiring lines.

In this case, a plurality of lead wiring lines are electrically connected to one of the three image signal lines, and image signals are time-sequentially supplied from the one of the three image signal lines to the plurality of connected lead wiring lines. Therefore, the number of three image signal lines can be extremely smaller than the number of three lead wiring lines (in other words, the number of three sampling switches, the number of three data lines, or the number of three sub-pixels).

In the case of this configuration, a plurality of lead wiring lines are connected to one image signal line, and therefore the effects of potential variations due to capacitive coupling in the lead wiring lines become extremely large. Accordingly, reducing the possibilities of the potential variations in the lead wiring lines can efficiently reduce the adverse effects of the potential variations on a displayed image.

In the electro-optical device according to the first aspect of the invention, it is preferable that a plurality of external circuit connection terminals provided along one side of the substrate be included, and that the three image signal lines be electrically connected respectively to the plurality of external circuit connection terminals on a side on which the three image signal lines are not connected to the three lead wiring lines.

In this case, the plurality of external circuit connection terminals for electrical conduction with a circuit outside of the substrate is provided along one side of the substrate. By electrically connecting a connection wiring line, for example, through a connector or the like to the plurality of external circuit connection terminals, electrical conduction with the external circuit is established.

In this case, the plurality of external circuit connection terminals are electrically connected to the three image signal lines. Therefore, image signals that have been input from the external circuit connection terminals can be reliably supplied through the three image signal lines to the three lead wiring lines.

In the above case where the external circuit connection terminals are included, a peripheral driving circuit may be included which is provided so as to overlap a position of linearly connecting the plurality of external circuit connection terminals and the three sampling switches with each other, and the three image signal lines may be provided so as to detour the peripheral driving circuit.

In this case, the peripheral driving circuit, such as a data line driving circuit, is provided at a position of linearly connecting the plurality of external circuit connection terminals and the three sampling switches with each other. That is, members are arranged so that the peripheral driving circuit is disposed between the plurality of external circuit connection terminals and the sampling switches.

Particularly in this case, the three image signal lines are provided so as to detour the peripheral driving circuit. That is, the plurality of external circuit connection terminals and the three lead wiring lines are electrically connected so as not to overlap the peripheral driving circuit. Therefore, the lengths of the three image signal lines are made longer by the length corresponding to the detour of the peripheral driving circuit. This therefore increases the potential variations due to capacitive coupling produced in the three image signal lines.

However, in this case, reducing the possibilities of the potential variations in the lead wiring lines can efficiently reduce adverse effect of the potential variations on a displayed image. Accordingly, it is possible to display a high-quality color image.

An electronic apparatus according to a second aspect of the invention includes the electro-optical device (including modifications thereof) according to the first aspect of the invention.

With the electronic apparatus according to the second aspect of the invention, which includes the electro-optical device according to the first aspect of the invention, it is possible to implement various kinds of electronic apparatuses, such as projection type display devices, television sets, cellular phones, electronic notebooks, word processors, viewfinder type or monitor-direct-view-type video tape recorders, workstations, video telephones, point-of-sale (POS) terminals and touch panels, which can perform high-quality color display. Also, as electronic apparatuses according to the second aspect of the invention, electrophoretic devices, such as electronic paper, and the like can be implemented.

Actions and other advantages of the aspects of the invention will be apparent from the exemplary embodiments to be described below.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the accompanying drawings.

Electro-Optical Device

With reference to FIGS. 1 to 6, an electro-optical device according to this embodiment is described. Note that, in the below-described embodiment, a built-in-driving-circuit-type liquid crystal device in a TFT active-matrix driving method is taken as an example of an electro-optical device according to an embodiment of the invention.

First, the whole configuration of a liquid crystal device according to this embodiment is described with reference to FIGS. 1 and 2. Herein, FIG. 1 is a plan view showing a configuration of a liquid crystal device according to this embodiment, and FIG. 2 is a sectional view taken along the line II-II of FIG. 1.

Figure 1:
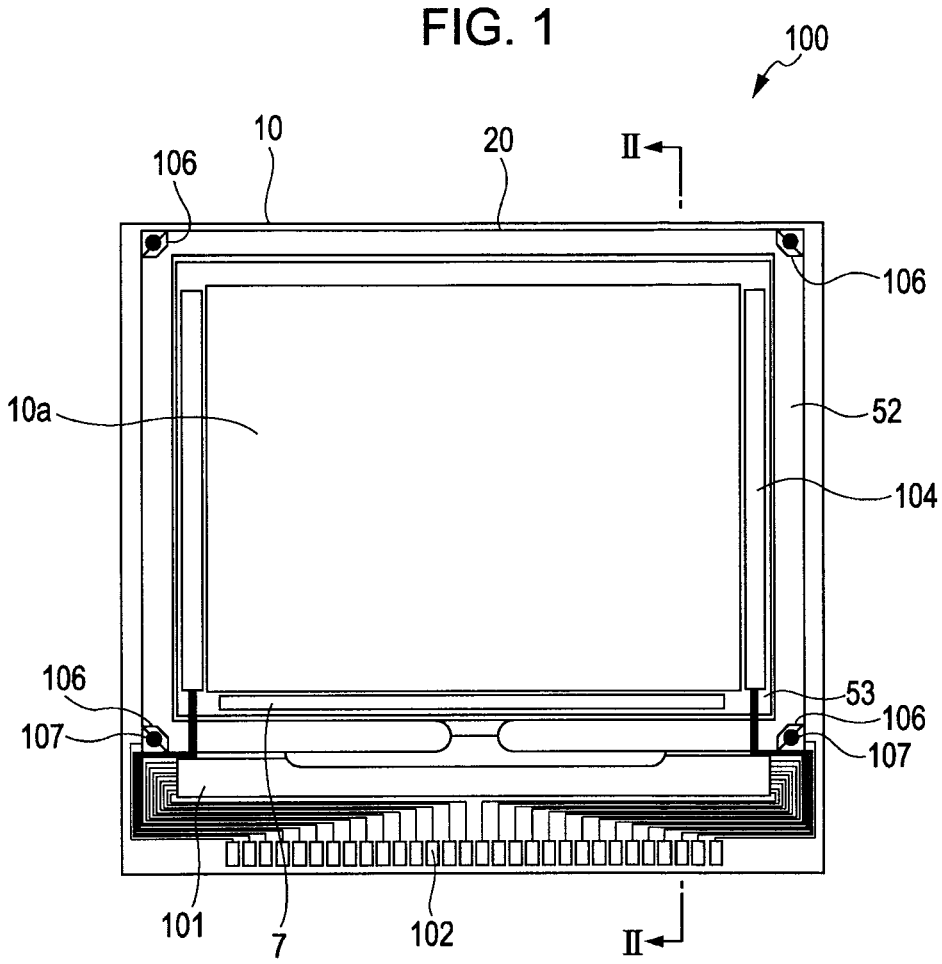
FIG. 1 is a plan view showing a configuration of a liquid crystal device according to an embodiment.
Figure 2:
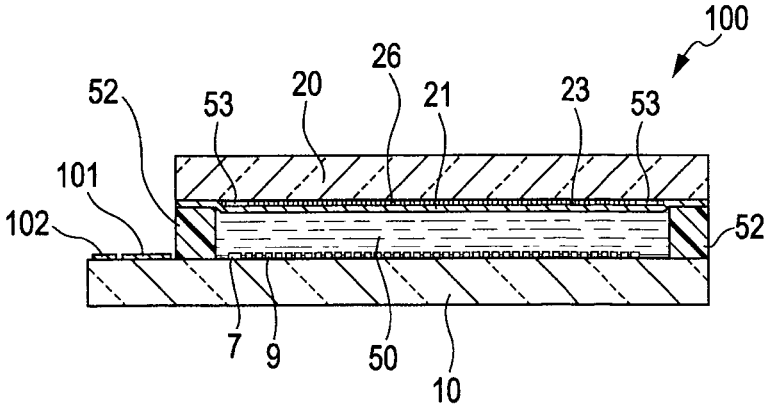
FIG. 2 is a sectional view taken along the line II-II of FIG. 1.

With reference to FIGS. 1 and 2, in a liquid crystal device 100 according to this embodiment, a TFT array substrate 10 and a counter substrate 20, which are one example of a "substrate" in accordance with an embodiment of the invention, face each other. A liquid crystal layer 50 is enclosed between the TFT array substrate 10 and the counter substrate 20. The TFT array substrate 10 and the counter substrate 20 are adhered to each other with a sealing member 52 provided in a sealing region located around an image display region 10*a*.

With reference to FIG. 1, a frame-shaped light-shielding film 53 having a light-shielding property, which defines a frame-shaped region of an image display region 10*a*, is parallel to the inner side of the sealing region in which the sealing member 52 is disposed. The frame-shaped light-shielding film 53 is provided on the side of the counter substrate 20. Note that, in this embodiment, there exists a peripheral region that defines the periphery of the image display region 10*a*. In other words, in this embodiment, an area farther from the frame-shaped light-shielding film 53 as viewed from the center of the TFT array substrate 10 is defined as the peripheral region.

In an area, of the peripheral region, located outside of the sealing region in which the sealing member 52 is disposed, a data line driving circuit 101 and external circuit connecting terminals 102 are provided along one side of the TFT array substrate 10. A sampling circuit 7 is provided inside of the sealing region along the one side in such a manner as to be covered with the frame-shaped light-shielding film 53. Scanning line driving circuits 104 are provided inside of the sealing region along two sides adjacent to the one side in such a manner as to be covered with the frame-shaped light-shielding film 53. Further, on the TFT array substrate 10, vertical conduction terminals 106 for connecting both substrates using a vertical conduction member 107 are disposed in areas facing four corner portions of the counter substrate 20. These components enable electrical conduction between the TFT array substrate 10 and the counter substrate 20 to be established.

With reference to FIG. 2, formed on the TFT array substrate 10 is a multilayer structure having pixel-switching TFTs and lines, such as scanning lines and data lines, built therein. In the image display region 10*a*, pixel electrodes 9 are provided in a matrix above pixel-switching TFTs and lines such as scanning lines and data lines. An alignment layer is formed over the pixel electrodes 9. On the other hand, on a surface facing the TFT array substrate 10 of the counter substrate 20, a color filter 26 is formed with a certain thickness so as to face each pixel electrode 9. In this embodiment, a single one unit pixel is made up of three sub-pixels; for each of the sub-pixels, the pixel electrode 9, pixel-switching TFT, the color filter 26 and the like are provided. A red (R) color filter, a green (G) color filter and a blue (B) color filter are respectively provided for the three sub-pixels included in a unit pixel. The red color filter is a color filter through which only red light (i.e., light with a wavelength ranging from 625 to 740 nm) passes, a green color filter is a color filter through which only green light (i.e., light with a wavelength ranging from 500 to 565 nm) passes, and a blue color filter is a color filter through which only blue light (i.e., light with a wavelength ranging from 450 to 485 nm) passes. Note that the color filters 26 may be provided on the side of the TFT array substrate 10.

A light-shielding film 23 is formed between the color filters 26 adjacent to each other on a surface facing the TFT array substrate 10 of the counter substrate 20. The light-shielding film 23 is formed of, for example, light shielding metal or the like, and is patterned with, for example, a grid or the like in the image display region 10*a* on the counter substrate 20. A counter electrode 21 made of a transparent material such as ITO (indium tin oxide) is formed to extend over a protective film (not shown), which is formed on the color filters 26 and the light-shielding film 23, so as to face a plurality of pixel electrodes 9. An alignment layer is formed on the counter electrode 21. The liquid crystal layer 50 is made of a liquid crystal obtained by mixing one or several kinds of nematic liquid crystals, and is in a predetermined oriented state between such a pair of alignment layers.

Note that, in addition to the data line driving circuit 101 and the scanning line driving circuits 104, an inspection circuit, an inspection pattern and the like for inspecting the quality, defects and the like of a liquid crystal device being manufactured or a liquid crystal device at the time of shipping, which are not shown here, may be formed on the TFT array substrate 10.

Next, the electrical configuration of the liquid crystal device according to this embodiment is described with reference to FIG. 3. Here, FIG. 3 is a block diagram showing the electrical configuration of the liquid crystal device according to this embodiment.

Figure 3:
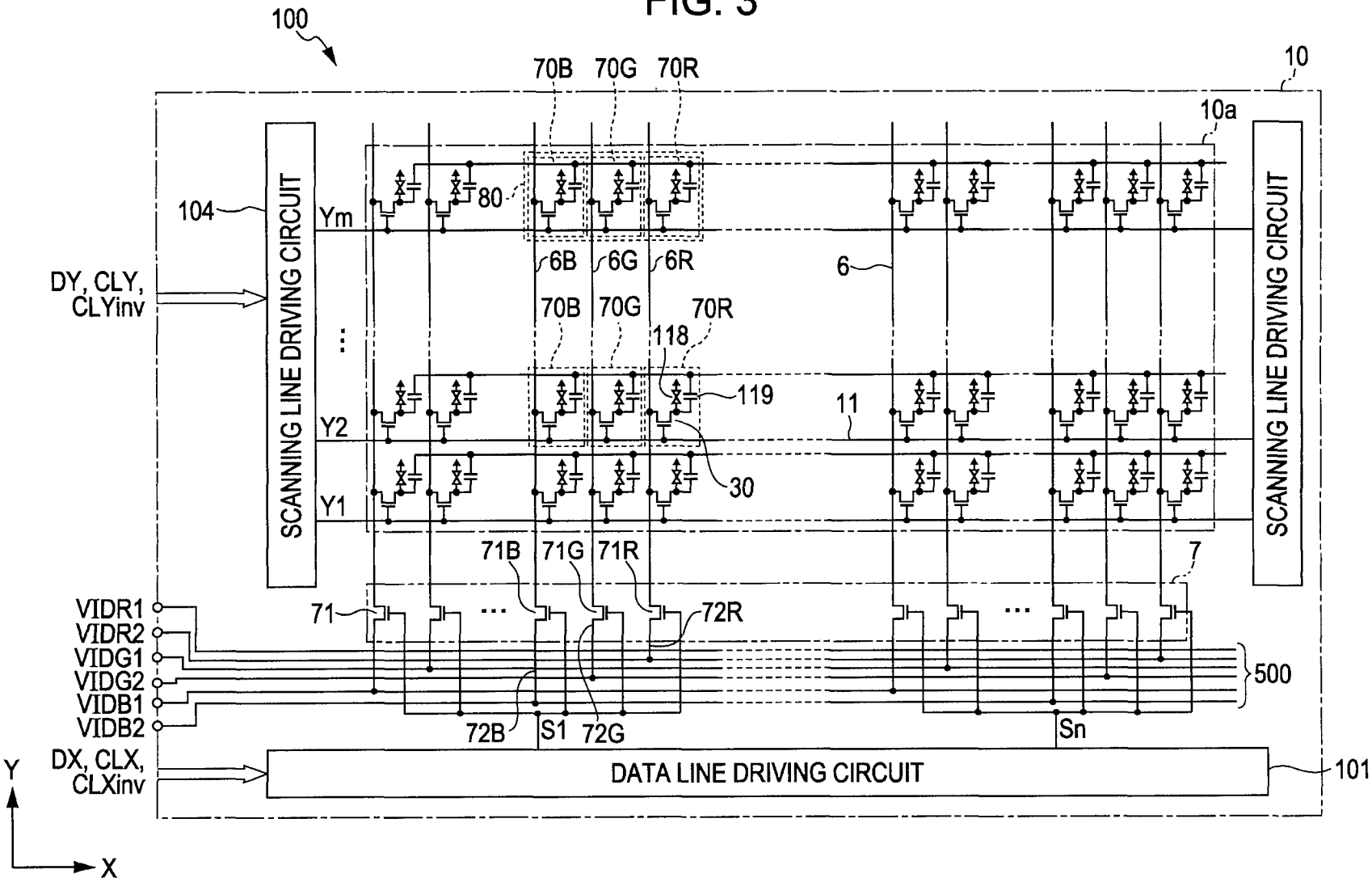
FIG. 3 is a block diagram showing an electrical configuration of the liquid crystal device according to the embodiment.

As shown in FIG. 3, the liquid crystal device 100 includes data lines 6 (i.e., data lines 6R, 6G and 6B) and scanning lines 11 arranged lengthwise and crosswise in the image display region 10*a* placed at the center of the TFT array substrate 10, and sub-pixels 70 are formed so as to correspond to points of intersection of the data lines 6 and the scanning lines 11. Each sub-pixel 70 includes the pixel electrode 9 of a liquid crystal element 118, a TFT 30 for switching control of the pixel electrode 9, and a storage capacitor 119. Note that this embodiment is described assuming that the total number of scanning lines 11 is m (m is a natural number greater than or equal to 2) and the total number of data lines 6 is n (n is a natural number greater than or equal to 2).

In this embodiment, a unit pixel 80 is made up of three sub-pixels 70 (i.e., sub-pixels 70R, 70G and 70B) adjacent to one another in a direction in which the scanning lines 11 extend (i.e., an X-direction). On the side of the counter substrate 20, the color filter 26 of red is provided to face the pixel electrode 9 of the sub-pixel 70R, the color filter 26 of green is provided to face the pixel electrode 9 of the sub-pixel 70G, and the color filter 26 of blue is provided to face the pixel electrode 9 of the sub-pixel 70B. Thus, color display is enabled in each unit pixel 80. Note that, in this embodiment, the red, green and blue color filters 26 are provided in the form of stripes along a direction in which the data lines 6 extend (i.e., a Y-direction). The sub-pixel 70 of any one of red, green and blue is electrically connected to a single one data line 6. That is, the red sub-pixel 70R is electrically connected to the data line 6R, the green sub-pixel 70G is electrically connected to the data line 6G, and the blue sub-pixel 70B is electrically connected to the data line 6B.

As shown in FIG. 3, the liquid crystal device 100 includes the scanning line driving circuits 104, the data line driving circuit 101, the sampling circuit 7, lead wiring lines 72 and image signal lines 500 in the peripheral region on the TFT array substrate 10.

A Y clock signal CLY, an inversion Y clock signal CLYinv and a Y start pulse DY are supplied to the scanning line driving circuit 104 through the external circuit connection terminals 102 (see FIG. 1) from the external circuit. Upon input of the Y start pulse DY, the scanning line driving circuit 104 sequentially generates and outputs scanning signals Y1, . . . , Ym at timings based on the Y clock signal CLY and the inversion Y clock signal CLYinv.

An X clock signal CLX, an inversion X clock signal CLXinv and an X start pulse DX are supplied to the data line driving circuit 101 through the external circuit connection terminals 102 (see FIG. 1) from the external circuit. Upon input of the X start pulse DX, the data line driving circuit 101 sequentially generates and outputs sampling signals S1, . . . , Sn at timings based on the X clock signal CLX and the inversion X clock signal CLXinv.

The sampling circuit 7 includes a plurality of sampling transistors 71 provided on the respective data lines 6. More particularly, the sampling circuit 7 includes a plurality of sampling transistors 71R that are provided on the respective data lines 6R electrically connected to the red sub-pixels 70R, a plurality of sampling transistors 71G that are provided on the respective data lines 6G electrically connected to the green sub-pixels 70G, and a plurality of sampling transistors 71B that are provided on the respective data lines 6B electrically connected to the blue sub-pixels 70B. The sampling transistors 71R, 71G and 71B are each formed of an N-channel TFT or a P-channel TFT, for example. Note that the sampling transistors 71R, 71G and 71B are one example of "three sampling switches" in accordance with an embodiment of the invention. The layout of the sampling transistors 71R, 71G and 71B on the TFT array substrate 10 is to be described in detail later.

Six image signal lines 500 are provided in this embodiment. Image signals VIDR1 and VIDR2 corresponding to red, image signals VIDG1 and VIDG2 corresponding to green, and image signals VIDB1 and VIDB2 corresponding to blue are supplied to the six image signal lines 500.

The lead wiring lines 72 are provided as lines for electrically connecting the sampling circuit 7 with the image signal lines 500. Specifically, the image signal lines 500 to which the image signals VIDR1 and VIDR2 corresponding to red are supplied are electrically connected through lead wiring lines 72R to the sampling transistors 71R. The image signal lines 500 to which the image signals VIDG1 and VIDG2 corresponding to green are supplied are electrically connected through lead wiring lines 72G to the sampling transistors 71G. The image signal lines 500 to which the image signals VIDB1 and VIDB2 corresponding to blue are supplied are electrically connected through lead wiring lines 72B to the sampling transistors 71B. Note that a plurality of lead wiring lines 72 are connected to one image signal line 500.

Paying attention to the configuration of one sub-pixel 70 shown in FIG. 3, the data line 6, to which an image signal is supplied, is electrically connected to a source electrode of the TFT 30. On the other hand, the scanning line 11, to which a scanning signal Yj (j=1, 2, 3, . . . , m) is supplied, is electrically connected to a gate electrode of the TFT 30, and the pixel electrode 9 of the liquid crystal element 118 is electrically connected to a drain electrode of the TFT 30. Here, in each sub-pixel 70, the liquid crystal element 118 includes a liquid crystal sandwiched between the pixel electrode 9 and the counter electrode 21. Here, in order to prevent an image signal held in the sub-pixel 70 from leaking, the storage capacitor 119 is added in parallel to the liquid crystal element 118.

The scanning lines 11 are line-sequentially selected by the scanning signals Y1, . . . , Ym output from the scanning line driving circuit 104. In the sub-pixel 70 corresponding to the selected scanning line 11, upon supply of the scanning signal Yj to the TFT 30, the TFT 30 is turned on to cause the sub-pixel 70 to be in the selected state. By closing the switch of that TFT 30 only for a certain period of time, an image signal is supplied at a predetermined timing from the data line 6 to the pixel electrode 9 of the liquid crystal element 118.

Thus, a voltage defined by potentials of the pixel electrode 9 and the counter electrode 21 is applied to the liquid crystal element 118. Liquid crystals modulate light to enable gray-scale display as the orientation or order of molecular assemblies vary in accordance with the applied voltage level.

Figure 4:
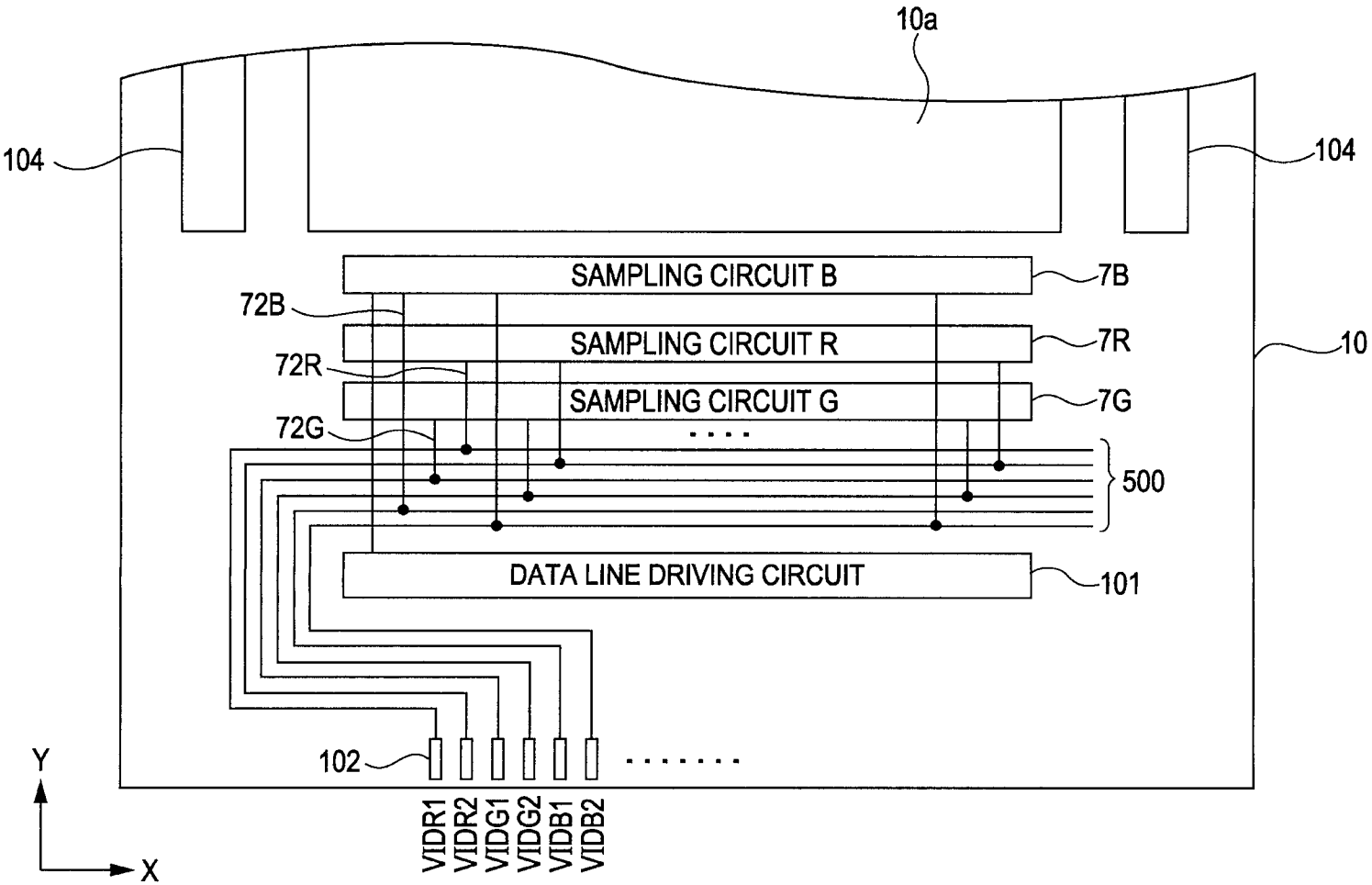
FIG. 4 is a first enlarged plan view showing a configuration of the periphery of sampling circuits of the liquid crystal device according to the embodiment.
Figure 5:
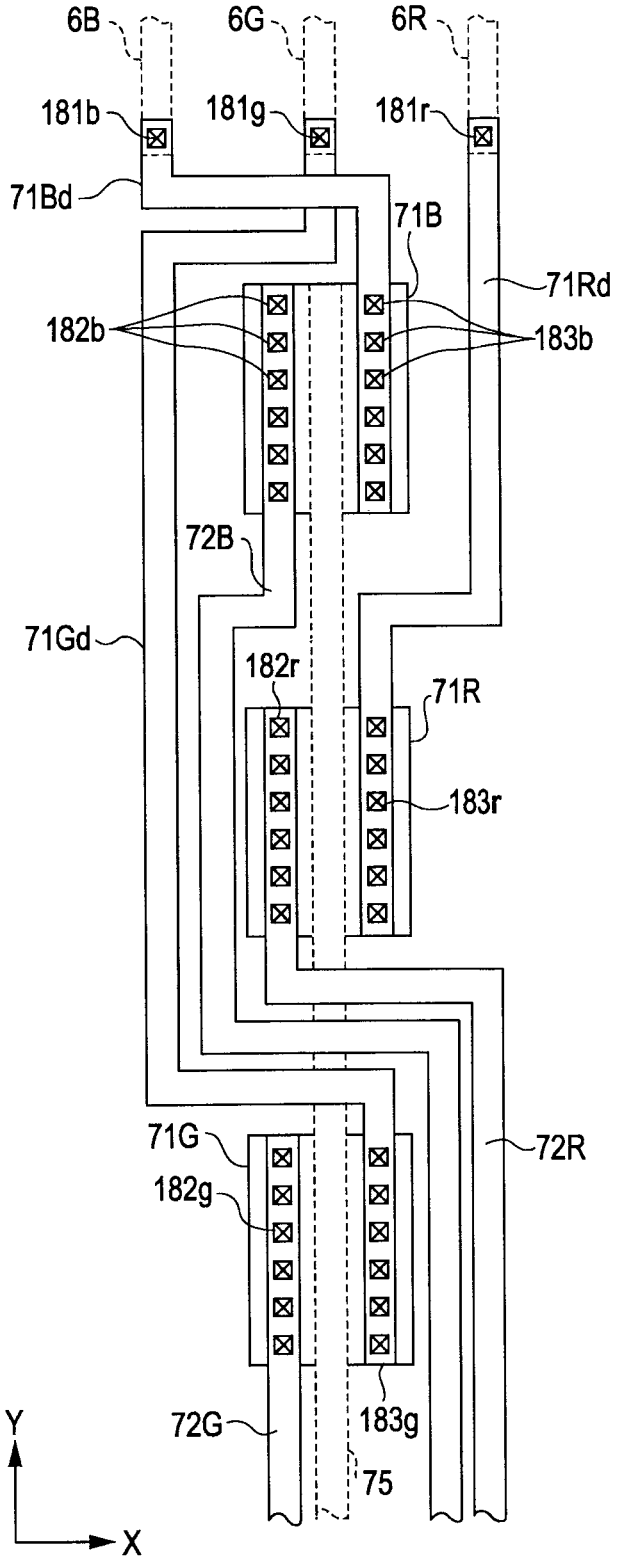
FIG. 5 is an enlarged plan view showing a specific line layout of sampling transistors of the liquid crystal device according to the embodiment.
Figure 6:
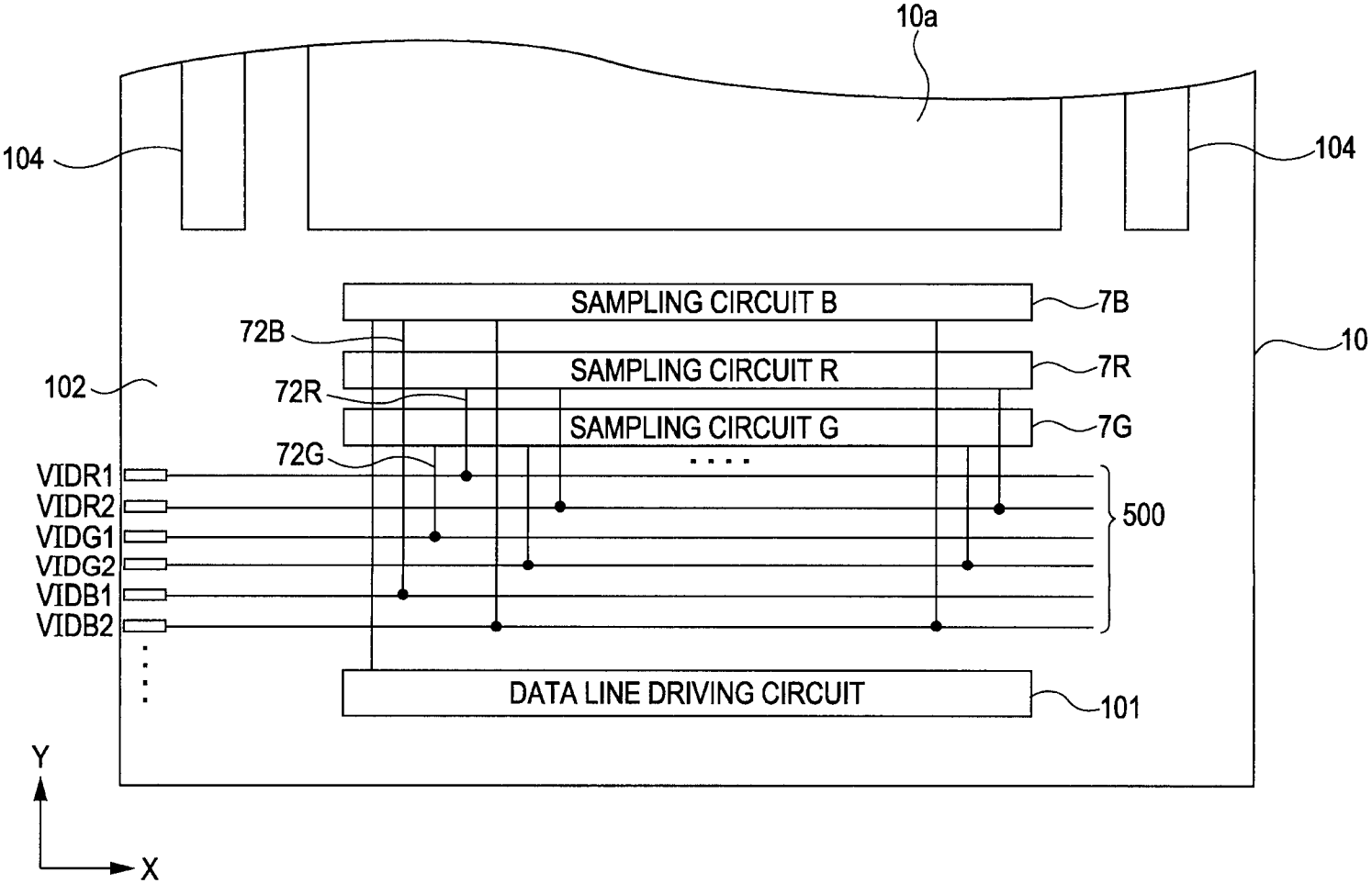
FIG. 6 is a second enlarged plan view showing a configuration of the periphery of sampling circuits of the liquid crystal device according to the embodiment.

Next, the layout of sampling transistors of the liquid crystal device according to this embodiment is described with reference to FIGS. 4 to 6. Here, FIGS. 4 to 6 are enlarged plan views each showing the configuration of the periphery of the sampling circuit of the liquid crystal device according to the embodiment. FIG. 5 is an enlarged plan view showing a specific line layout of sampling transistors of the liquid crystal device according to the embodiment.

As shown in FIG. 4, a plurality of sampling circuits 7 (i.e., a sampling circuit 7R, a sampling circuit 7G and a sampling circuit 7B) are arranged in the X-direction and are disposed so as to be displaced from one another in the Y-direction, according to the colors of the respective sub-pixels 70, in the peripheral region located in the periphery of the image display region 10*a* in which the unit pixels 80 are arranged in a matrix. Specifically, the sampling circuit 7G corresponding to green is arranged in the X-direction. The sampling circuit 7R corresponding to red is arranged along the X-direction so as to be more distant in the Y-direction from the image signal lines 500 than the sampling circuit 7G. The sampling circuit 7B corresponding to blue is arranged along the X-direction so as to be more distant in the Y-direction from the image signal lines 500 than the sampling circuit 7R.

That is, in this embodiment, the plurality of sampling circuits 7 (in other words, the sampling transistors 71) are not arranged so as to form one row along the X-direction but are arranged so as to form three rows along the X-direction with respect to the color of the corresponding sub-pixel 70. Therefore, even with a small arrangement pitch of the sub-pixel 70, it is possible to easily arrange a plurality of sampling transistors 71 in the peripheral region while sufficiently securing the sizes of the sampling transistors 71.

With reference to FIG. 5, the lead wiring line 72G (in other words, a source wiring line of the sampling transistor 71G) connected to the sampling transistor 71G is electrically connected through contact holes 182*g* to a source region in the semiconductor layer included in the sampling transistor 71G. The lead wiring line 72G has its end on a side opposite to the side connected to the sampling transistor 71G. At the end, the lead wiring line 72G is electrically connected to the corresponding image signal line 500 through a contact hole or the like (see FIG. 3). A drain wiring line 71Gd of the sampling transistor 71G is electrically connected through contact holes 183*g* to a drain region in the semiconductor layer included in the sampling transistor 71G. The drain wiring line 71Gd has its end on a side opposite to the side connected to the sampling transistor 71G. At the end, the drain wiring line 71Gd is electrically connected to the corresponding data line 6G through a contact hole 181*g*.

The lead wiring line 72R (in other words, a source wiring line of the sampling transistor 71R) connected to the sampling transistor 71R is electrically connected through contact holes 182*r* to a source region in the semiconductor layer included in the sampling transistor 71R. The lead wiring line 72R has its end on a side opposite to the side connected to the sampling transistor 71R. At the end, the lead wiring line 72R is electrically connected to the corresponding image signal line 500 through, for example, a contact hole (see FIG. 3). A drain wiring line 71Rd of the sampling transistor 71R is electrically connected through contact holes 183*r* to a drain region in the semiconductor layer included in the sampling transistor 71R. The drain wiring line 71Rd has its end on a side opposite to the side connected to the sampling transistor 71R. At the end, the drain wiring line 71Rd is electrically connected to the corresponding data line 6R through a contact hole 181*r*.

The lead wiring line 72B (in other words, a source wiring line of the sampling transistor 71B) connected to the sampling transistor 71B is electrically connected through contact holes 182*b* to a source region in the semiconductor layer included in the sampling transistor 71B. The lead wiring line 72B has its end on a side opposite to the side connected to the sampling transistor 71B. At the end, the lead wiring line 72B is electrically connected to the corresponding image signal line 500 through, for example, a contact hole (see FIG. 3). A drain wiring line 71Bd of the sampling transistor 71B is electrically connected through contact holes 183*b* to a drain region in the semiconductor layer included in the sampling transistor 71B. The drain wiring line 71Bd has its end on a side opposite to the side connected to the sampling transistor 71B. At the end, the drain wiring line 71Bd is electrically connected to the corresponding data line 6B through a contact hole 181*b*.

With reference to FIG. 5, a sampling signal line 75 is formed so as to include gate electrodes of the sampling transistors 71G, 71R and 71B corresponding to the sub-pixels 70G, 70R and 70B included in the same unit pixel 80. The sampling signal line 75 has its end on a side opposite to the side including the gate electrodes. At the end, the sampling signal line 75 is electrically connected to the data line driving circuit 101 (see FIG. 3). During the operation of the liquid crystal device 100, a sampling signal Si is supplied at a predetermined timing to the sampling signal line 75 from the data line driving circuit 101.

With reference to FIG. 4 and FIG. 5, particularly in this embodiment, the sampling circuit 7G corresponding to green is disposed closer to the image signal lines 500 than the other sampling circuits 7R and 7B.

Therefore, the lead wiring line 72G connected to the sampling transistors 71G corresponding to green can be made shorter than the lead wiring lines 72R and 72B connected respectively to the other sampling transistors 71R and 71B. Accordingly, among the lead wiring lines 72G, 72R and 72B connected respectively to the sampling transistors 71G, 71R and 71B, the lead wiring line 72G of the sampling transistor 71G can be made so that a rounded signal waveform caused by wiring capacitance and variations in potential due to capacitive coupling between this wiring line and another wiring line are least likely to occur.

Thus, a rounded signal waveform and variations in potential can be reduced in the lead wiring line 72G that is electrically connected to the sampling circuit 7G corresponding to green, which offers the highest luminosity factor (i.e., most easily sensed by a human eye) among red, blue and green. Here, even when variations in potential occur in the lead wiring lines 72R and 72B electrically connected to the sampling circuits 7R and 7B respectively corresponding to red and blue, there is little or practically no adverse effect on display since red and blue offer lower luminosity factors lower than green. As a result, a high-quality color image can be displayed.

Further, particularly in this embodiment, the sampling circuit 7B corresponding to blue is disposed so as to be more distant from the image signal lines 500 than the sampling circuit 7R corresponding to red.

Accordingly, the potential variations in the lead wiring line 72R electrically connected to the sampling circuit 7R corresponding to red can be made lower than the potential variations in the lead wiring line 72B electrically connected to the sampling circuit 7B corresponding to blue. Here, since blue offers a luminosity factor lower than red, it can be made difficult to visually recognize the adverse effects on display due to potential variations that can be produced in the lead wiring line 72, compared to the hypothetical case in which the plurality of sampling transistors 71R are disposed so as to be more distant from the image signal lines 500 than the plurality of sampling transistors 71B.

With reference to FIG. 6, the image signal lines 500 of the liquid crystal device according to this embodiment do not have to be provided so as to detour the data line driving circuit 101 as shown in FIG. 4. That is, the image signal lines 500 may be linearly connected to the external circuit connection terminals 102 provided along a lateral side of the TFT array substrate 10.

In this case, the lengths of the image signal lines 500 can be shortened, and therefore the proportion of the capacitive coupling in the lead wiring lines 72 in the capacitive coupling in the whole lines becomes large. Accordingly, the aforementioned advantage according to this embodiment becomes more remarkably effective.

As described above, the liquid crystal device according to this embodiment makes it difficult to visually recognize adverse effects on display, which are caused by a rounded signal waveform due to wiring capacitance and potential variations due to the influence of other wiring lines that can be produced in the lead wiring lines 72, and thus enables a high-quality image to be displayed.

Note that, in this embodiment, the image signal lines are described using the example in which they are arranged in the order of red, green and blue from the closest to the sampling circuit 7 to the farthest. However, the image signal line corresponding to green may be arranged at a position closest to the sampling circuit 7. This enables the length of the lead wiring line 72G to be further shortened, and is therefore more effective. For example, the image signal lines are arranged in the order of green, red and blue from the closest to the sampling circuit 7 to the farthest. This can achieve effective arrangement in consideration to the luminosity factor.

Electronic Apparatus

Next, a description is given of cases where the liquid crystal device, which is the above-described electro-optical device, is applied to various kinds of electronic apparatuses.

First, a projector using the liquid crystal device as a light bulb is described with reference to FIG. 6. Here, FIG. 6 is a plan view showing a configuration example of the projector.

As shown in FIG. 6, a lamp unit 1102 made of a white light source, such as a halogen lamp, is provided inside of the projector 1100. Projected light emitted from the lamp unit 1102 is reflected from three mirrors 1106 disposed in a light guide 1104, and is incident on a liquid crystal panel 1110.

The configuration of the liquid crystal panel 1110 is equivalent to that of the aforementioned liquid crystal device such that the liquid crystal panel 1110 is driven by R, G and B image signals supplied from an image signal processing circuit. A color image displayed by modulating light using the liquid crystal panel 1110 is projected through a projector lens 1114 on a screen or the like.

Next, an example of applying the aforementioned liquid crystal device to a cellular phone is described with reference to FIG. 7. Here, FIG. 7 is a perspective view showing a configuration of the cellular phone.

Figure 7:
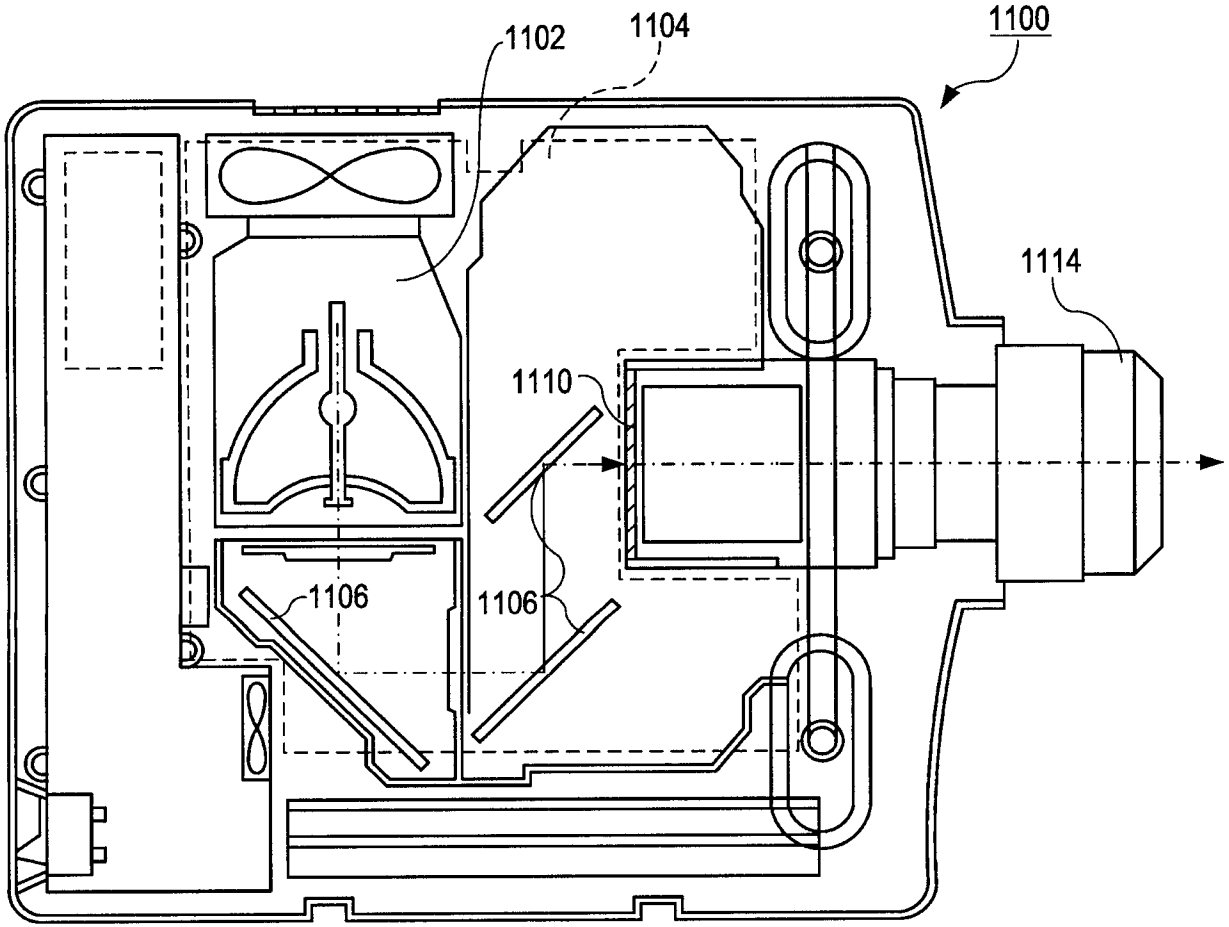
FIG. 7 is a plan view showing a configuration of a projector that is one example of an electronic apparatus to which the electro-optical device is applied.
Figure 8:
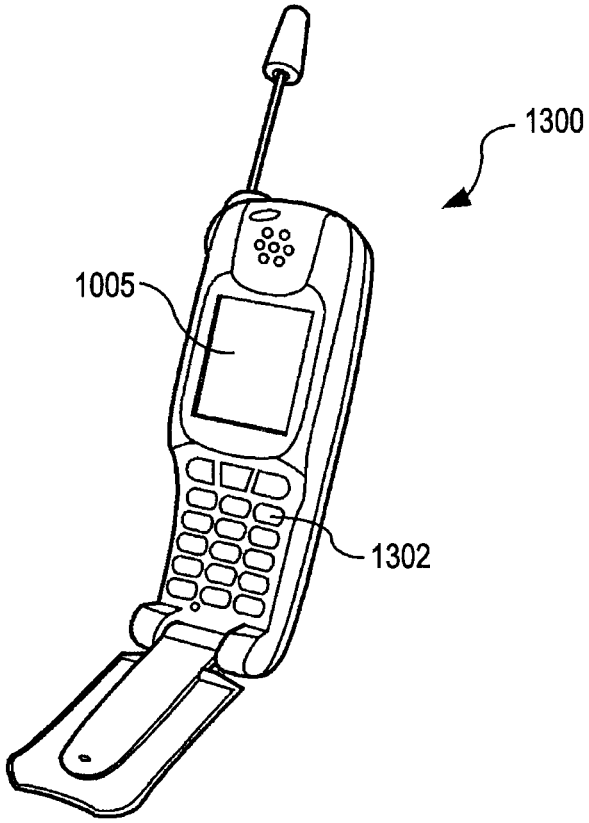
FIG. 8 is a perspective view showing a configuration of a cellular phone that is one example of the electronic apparatus to which the electro-optical device is applied.

With reference to FIG. 7, a cellular phone 1300 includes a display section 1005 to which the aforementioned liquid crystal device is applied, as well as a plurality of operation buttons 1302.

Note that, in addition to the electronic apparatuses described with reference to FIG. 6 and FIG. 7, mobile personal computers, liquid crystal television sets, viewfinder type or monitor-direct-view-type video tape recorders, car navigation devices, pagers, electronic notebooks, electronic calculators, word processors, workstations, video telephones, point-of-sale (POS) terminals, devices provided with touch panels, and the like are mentioned. It will be understood that the liquid crystal device can be applied to these various kinds of electronic apparatuses.

The invention can be applied to, in addition to the liquid crystal device described in the aforementioned embodiment, reflection-type liquid crystal devices (LCOS) in which an element is formed on a silicon substrate, plasma displays (PDP), field emission displays (FED, SED), organic electroluminescent (EL) displays, digital micro mirror devices (DMD), electrophoresis devices and the like.

The invention is not limited to the aforementioned embodiment, and can be appropriately changed in the scope without departing from the spirit or idea of the invention read from the scope of claims and the entire specification, and an electro-optical device with such a change and an electronic apparatus including the electro-optical device are also included within the technical scope of the invention.

The entire disclosure of Japanese Patent Application No. 2009-251754, filed Nov. 2, 2009 is expressly incorporated by reference herein.

What is claimed is:

1. An electro optical device comprising:

a first pixel that displays a first color;

a second pixel that displays a second color;

a third pixel that displays a third color;

a first sampling switch that is electrically connected to the first pixel;

a second sampling switch that is electrically connected to the second pixel; and a third sampling switch that is electrically connected to the third pixel, the first pixel, the second pixel, and the third pixel being disposed in a display area, the second sampling switch and the third sampling switch being disposed between the display area and the first sampling switch, the first sampling switch, one of the second sampling switch and the third sampling switch, and the display area being arranged toward a first direction, a first data signal being input to the first sampling switch, a second data signal being input to the second sampling switch, a third data signal being input to the third sampling switch, a luminosity factor of the first color being higher than a luminosity factor of the second color and a luminosity factor of the third color wherein:

the first color is green, the second color is red, and the third color is blue.

2. The electro optical device according to claim 1, the first data signal being supplied to the first sampling switch from an opposite side of a side of the one of the second sampling switch and the third sampling switch, the second data signal being supplied to the second sampling switch from a side of the first sampling switch, the third data signal being supplied to the third sampling switch from the side of the first sampling switch.

* * * * *